United States Patent [19]

Caughey

[11] 4,248,163

[45] Feb. 3, 1981

[54] PALLET HAVING DENSIFIED EDGE AND METHOD OF MAKING SAME

[75] Inventor: Robert A. Caughey, Antrim, N.H.; Bruce A. Haataja, Lake Linden; Tauno B. Kilpela, Atlantic Mine; James F. Hamilton, Houghton, all of Mich.

[73] Assignee: Board of Control of Michigan Technological University, Houghton, Mich.

[21] Appl. No.: 972,050

[22] Filed: Dec. 21, 1978

[51] Int. Cl.[3] ..... B65D 19/24

[52] U.S. Cl. ..... 108/53.3; 108/51.1; 108/901; 264/119

[58] Field of Search ..... 108/53.3, 51.1, 51.3, 108/53.1, 53.5, 55.1–55.5, 57.1, 901; 264/119, 120; 52/821, 783

[56] References Cited

U.S. PATENT DOCUMENTS

| | | | |
|---|---|---|---|
| 3,199,469 | 8/1965 | Sullivan | 108/53.3 |
| 3,552,329 | 1/1971 | Parris | 108/51.1 |
| 3,661,688 | 5/1972 | Wheeler | 264/119 X |
| 3,759,193 | 9/1973 | Branch | 108/53.3 X |
| 3,880,092 | 4/1975 | Seeber et al. | 108/901 X |
| 4,029,023 | 6/1977 | Rosewicz et al. | 108/51.1 |
| 4,061,813 | 12/1977 | Geimer et al. | 264/119 X |
| 4,082,828 | 4/1978 | Zulli | 264/119 |
| 4,084,996 | 4/1978 | Wheeler | 264/119 X |

FOREIGN PATENT DOCUMENTS

| | | | |
|---|---|---|---|
| 1168418 | 10/1969 | United Kingdom | 108/51.1 |

*Primary Examiner*—William E. Lyddane

[57] ABSTRACT

A molded unitarily formed pallet is provided, the pallet including wood particles bonded together by a cured binder in compressed relation. Also provided is a method for making such pallets. The pallet includes a deck having an upper supporting surface, a lower surface, a plurality of integral leg sections extending downwardly from the deck, and a densified integral peripheral portion surrounding the deck to provide increased strength at the periphery of the pallet. The pallet may also include narrow elongated wooden strips bonded to the densified peripheral edge to further increase the strength of the pallet.

20 Claims, 5 Drawing Figures

PALLET HAVING DENSIFIED EDGE AND METHOD OF MAKING SAME

BACKGROUND OF THE INVENTION

The invention relates to pallets for use in material handling and a method for making such pallets. More particularly, the invention relates to pallets formed of wood flakes joined by a curing agent, and the pallets having peripheral edges constructed to resist damage.

One example of a prior art pallet is illustrated in the Rosewicz et al U.S. Pat. No. 4,029,023, issued June 14, 1977. Attention is also directed to the molded pallet illustrated in the Carlson U.S. Pat. No 3,359,929, issued Dec. 26, 1967.

Attention is further directed to the molded composite structures described in the Wheeler U.S. Pat. No. 3,661,688, issued May 9, 1972 and the Skladany U.S. Pat. No. 3,104,085, issued Sept. 17, 1963.

SUMMARY OF THE INVENTION

The invention provides an improved molded unitary wood pallet having peripheral edges comprised of densified material and thereby having greater strength and more resistance to damage. The invention also provides a method for making such pallets.

The invention includes a molded unitarily formed pallet including wood particles bonded together by a cured binder in compressed relation, the pallet including a deck having an upper supporting surface and a lower surface, and including a plurality of integral leg sections extending downwardly from the deck for supporting the deck. The deck includes a densified peripheral edge comprised of wood particles and cured binder more tightly compressed than the remainder of the deck.

One of the features of the invention is the provision in the pallet of a recess around the deck defined by the densified peripheral edge, and a plurality of elongated narrow reinforcing strips surrounding the deck, the strips being bonded to the densified peripheral edge and located in the recess.

Another of the principal features of the invention is the provision of a pallet comprised of wood flakes bonded together in stacked interleaved compressed relationship.

The invention also includes a method for making a unitarily constructed pallet having a densified edge, the method including the steps of providing a mold apparatus having a female mold member and the male mold member being engageable to form a mold cavity including a planar cavity portion and a peripheral portion surrounding the planar cavity portion, the peripheral portion being thinner than the planar cavity portion. The method of the invention also includes the steps of placing a mat comprised of wood particles and a binder material between the female and male mold members, and forcing the female mold member and the male mold member together to shape the pallet and thereby compress the peripheral edge more than the planar body portion whereby the pallet has a densified peripheral edge.

Other features and advantages of the invention will become known by reference to the following description, to the appended claims, and to the drawings.

Figure 1:
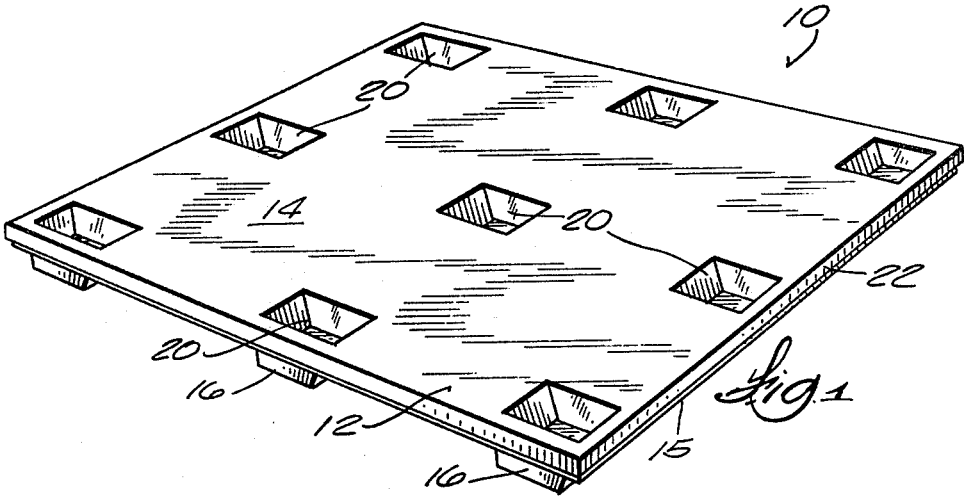
FIG. 1 is a perspective view of a pallet embodying the invention.
Figure 2:
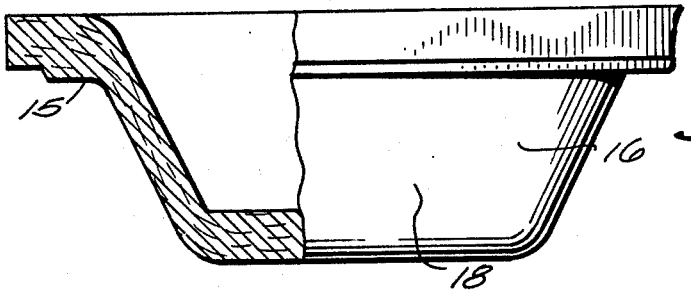
FIG. 2 is an enlarged fragmentary elevation view of the pallet illustrated in FIG. 1.

Before describing at least one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in FIG. 1 is a rectangular pallet 10 of the type for use in material handling applications. In one preferred embodiment, the pallet is unitarily constructed of wood particles bonded together by a suitable binding agent. The pallet 10 includes a planar deck 12 including an upper supporting surface 14 and a lower planar surface 15. The pallet 10 also includes a plurality of downwardly extending supporting legs 16 having generally rectangular bottom portions 18. The supporting legs 16 taper upwardly and outwardly to the lower surface of the planar deck 12.

The legs 16 are arranged in three mutually spaced apart parallel rows, each row comprised of three legs 16. The legs 16 form two pairs of mutually perpendicular ways beneath the planar deck 12 so that the tines of a lift truck can be positioned beneath the planar deck 12 of the pallet to facilitate movement of the pallet. The mutually perpendicular ways permit the lift forks to engage any of the four peripheral sides of the pallet 10.

The pallets 10 are also constructed such that they can be conveniently stored in nested stacked relation. To facilitate such nesting of the pallets, the legs 16 each include a central upwardly opening hollow cavity 20 for receiving the downwardly extending legs 16 of an adjacent pallet.

The pallet 10 is also constructed in such a manner that the periphery 22 of the pallet is particularly resistant to chipping, cracking or other damage which might otherwise be caused by rough handling of the pallet. To provide such resistance to damage, the peripheral edges of the pallet 10 are constructed so as to be densified. The densified edge is formed by causing that portion of the wood particle and binder material forming the peripheral edge of the pallet 10 to be compressed to a greater degree than the material forming the remainder of the deck 12 and forming the legs 16 of the pallet.

Figure 3:
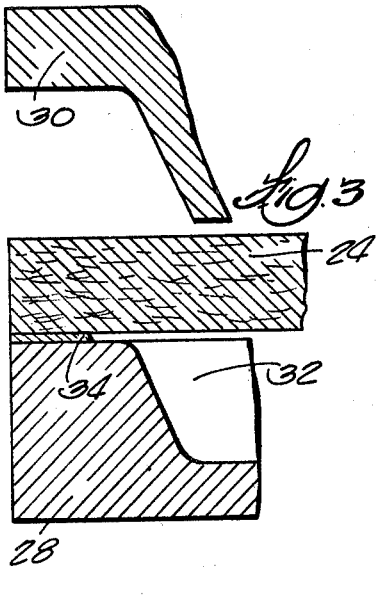
FIG. 3 is a fragmentary elevation view of mold apparatus used in molding the pallet shown in FIG. 1 and showing a mat positioned between the mold members.
Figure 4:
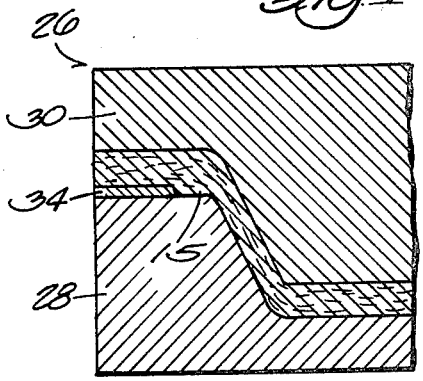
FIG. 4 is a view similar to FIG. 3 but showing the mold members forming a pallet therebetween.

As illustrated in FIGS. 3 and 4, the pallet 10 may be formed by laying a planar mat 24 formed from a mixture of wood particles and a bonding agent in a mold apparatus 26. While various compositions can be used to form the mat 24, in the preferred embodiment, the mat is formed in the manner specified in a copending patent application titled "Pallets and Other Articles Having Non-Planor Portions Molded from Matted Wood Flakes", U.S. Pat. application Ser. No. 972,034 filed Dec. 21, 1978, and assigned to assignees of the present application. As defined more specifically in that copending application, the wood particles in the mat 24 comprise thin elongated wood flakes laid together in stacked interleaved relationship to form a loosely felted layered mat and are intermixed with an organic binder. As also defined in that application, each layer of wood flakes in the mat lies substantially flat in a plane generally parallel to the plane of the mat and are randomly oriented to each other. The wood flakes have an average length of about $1\frac{1}{4}$ to about 6 inches, preferably about 2 to about about 3 inches, an average thickness of about 0.005 to 0.075 inches, preferably about 0.005 to about 0.025 inches and an average width of 3 inches or less and no greater than the average length. The pallet contains about 2 to about 15 weight % of the binder, and optionally about 0.5 to 2 weight % based on the dry weight of the wood flakes, of a wax to provide waterproof protection. Organic polyisocyanates, either alone or in combination with urea-formaldehyde, are the preferred binders.

In the illustrated construction, the mold apparatus 26 includes a female mold member 28 and male mold member 30 forming a mold cavity 32 having a configuration suitable to form the pallet 10. The female mold member 28 is further provided with a shim 34 surrounding the periphery of the mold cavity 32 and located in the peripheral corner of the mold cavity intended to form the periphery of the lower surface of the deck 12. When the mold members 28 and 30 are brought together, as illustrated in FIG. 4, the mat 24 is compressed between the mold members 28 and 30 to thereby form the deck 12 and legs 16. During the molding step, the shim 34 functions to deform and compress the material of the mat 24 and to form an edge surrounding the pallet deck 12 which is denser than the remainder of the material forming the deck 12. The increased density of the material forming the edge thereby provides for increased strength and resistance of the edge to damage.

Figure 5:
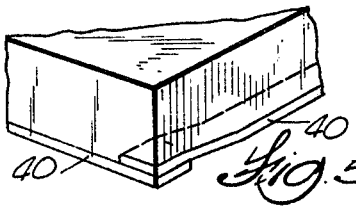
FIG. 5 is a fragmentary perspective view of a portion of a pallet embodying an alternative embodiment of the invention.

Illustrated in FIG. 5 is an alternative embodiment of the pallet 10 wherein thin wooden strips 40 are inlaid within the recess surrounding the lower surface of the deck and suitably bonded to the adjacent surfaces. The strips 40 function to reinforce the densified edges of the deck to improve the tensile strength of the pallet edges and to resist shear failure and shock loads.

In one preferred form, the reinforcing strips may be inlaid in the pallet by positioning resin treated veneer strips, comprised of ash or other dureable woods, in the mold before the mat is placed in the mold. The veneer strips could alternatively be laid in the mat during forming. To further reinforce the pallet edges and particularly to strengthen the pallet corners, the veneer strips can be cross-lapped at the corners as illustrated in FIG. 5. It will be appreciated by those skilled in the art that by placing the veneer strips 40 in the mold or on the mat prior to molding, the veneer strips will function to cause densification of the edges of the pallet during the molding operation and the shims used in the mode can be thinner or deleted.

Though the recess formed in the peripheral edges of the deck are shown as being formed adjacent the lower surface of the deck, one skilled in the art will appreciate that they could also be formed adjacent the upper surface of the deck by attaching shims 34 to the surface of the male mold member 30.

In other alternative embodiments, the pallet 10 can be provided with a densified edge by employing a mat 24 having a peripheral edge comprised of material with a higher bulk density than the material forming the remainder of the mat. For example, the wood flakes at the periphery of the mat could be thicker than the remainder of the flakes in the mat. Alternatively, the mat could be formed to have an increased thickness at its periphery such that when the mat is compressed, the periphery of the formed article has an increased density.

Various of the features of the invention are set forth in the following claims.

We claim:

1. A molded unitarily formed pallet comprising wood particles bonded together by a cured binder in compressed relation and forming: a deck having an upper supporting surface, a lower surface, and a peripheral edge, said peripheral edge being more highly compressed and having a density greater than the remainder of the said deck, and having greater strength and impact resistance than the remainder of said deck, and a plurality of integral leg sections extending downwardly from said deck for supporting said deck.

2. A molded unitarily formed pallet as set forth in claim 1 wherein said deck and said leg sections are molded as a one piece unit from a layered mixture of a resinous particle board binder and flake-like wood particles, each layer of said wood particles forming at least said deck member lying substantially flat in a plane generally parallel to the major plane with said wood particles therein being randomly oriented.

3. A pallet as set forth in claim 1 wherein said deck and leg members are molded from said wood particles by depositing a loosely-felted, layered mat of said mixture on one part of an open mold including two separable parts defining a mold chamber having the desired shape of said pallet, closing the mold and applying sufficient heat and pressure to said mat to compress it into substantially the desired shape and size of said pallet and to bond said wood particles together, said mold including means for compressing the peripheral edge of the deck more than the remainder of the deck.

4. A molded unitarily formed pallet comprising elongated thin wood flakes bonded together by a cured binder in compressed relation and forming a deck having an upper supporting surface, a lower surface, and a peripheral edge more highly compressed and having a density greater than the remainder of said deck, and having greater strength and impact resistance than the remainder of said deck, said peripheral edge having a thickness less than the remainder of said deck and said peripheral edge forming a ledge surrounding said deck, and a plurality of integral leg sections extending downwardly from said deck for supporting said deck.

5. A molded unitarily formed pallet as set forth in claim 4 wherein said deck and said leg sections are molded as a one piece unit from a layered mixture of a resinous particle board binder and flake-like wood particles, each layer of said wood particles forming at least said deck member lying substantially flat in a plane generally parallel to the major plane with said wood particles therein being randomly oriented.

6. A pallet as set forth in claim 4 wherein said deck and leg members are molded from said wood particles by depositing a loosely-felted, layered mat of said mixture on one part of an open mold including two separable parts defining a mold chamber having the desired shape of said pallet, closing the mold and applying sufficient heat and pressure to said mat to compress it into substantially the desired shape and size of said pallet and to bond said wood particles together, said mold including means for compressing the peripheral edge of the deck more than the remainder of the deck.

7. A molded unitarily formed pallet comprising wood particles bonded together by a cured binder in compressed relation and forming: a deck having an upper supporting surface, a lower surface, and a peripheral edge more highly compressed and having a density greater than the remainder of said deck to give said peripheral edge greater strength and impact resistance than the remainder of said deck a plurality of integral leg sections extending downwardly from said deck for supporting said deck, and a plurality of elongated narrow reinforcing strips surrounding said deck, each of said strips being bonded to said densified peripheral edge.

8. A molded unitarily formed pallet as set forth in claim 7 wherein said strips each include opposite ends, and wherein said ends of adjacent strips are overlapped.

9. A molded unitarily formed pallet as set forth in claim 7 and further including a recess around said deck adjacent said densified peripheral edge, said strips being located in said recess and bonded to said densified peripheral edge.

10. A molded pallet as set forth in claim 7 wherein said pallet is comprised of elongated thin wood flakes bonded together in stacked interleaved compressed relationship.

11. A molded pallet as set forth in claim 7 wherein said flat deck includes a plurality in said planar upper surface aligned with said leg sections and arranged to house leg sections of a second pallet stacked thereon.

12. A molded unitarily formed pallet as set forth in claim 7 wherein said deck and said leg sections are molded as a one piece unit from a layered mixture of a resinous particle board binder and flake-like wood particles, each layer of said wood particles forming at least said deck member lying substantially flat in a plane generally parallel to the major plane with said wood particles therein being randomly oriented.

13. A pallet as set forth in claim 7 wherein said deck and leg members are molded from said wood particles by depositing a loosely-felted, layered mat of said mixture on one part of an open mold including two separable parts defining a mold chamber having the desired shape of said pallet, closing the mold and applying sufficient heat and pressure to said mat to compress it into substantially the desired shape and size of said pallet and to bond said wood particles together.

14. A molded unitarily formed pallet comprising wood flakes bonded together in stacked interleaved compressed relationship by a cured binder and forming:

a deck having an upper supporting surface, a lower surface, and a peripheral edge more highly compressed and having a density greater than the remainder of said deck whereby said peripheral edge has greater strength and impact resistance than the remainder of said deck, said densified peripheral edge having a thickness less than the remainder of said deck whereby a recess is formed surrounding said deck;

a plurality of integral leg sections extending downwardly from said deck for supporting said deck, and said deck including a plurality of recesses in said planar upper surface aligned with said leg sections and adapted to house leg sections of a second pallet stacked thereon; and a plurality of elongated narrow reinforcing strips surrounding said deck, said strips being located in said recess and bonded to said densified peripheral edge.

15. A molded unitarily formed pallet as set forth in claim 14 wherein said deck and said leg sections are molded as a one piece unit from a layered mixture of a resinous particle board binder and flake-like wood particles, each layer of said wood particles forming at least said deck member lying substantially flat in a plane generally parallel to the major plane with said wood particles therein being randomly oriented.

16. A pallet according to claim 14 where in said deck and leg members are molded from said wood particles by depositing a loosely-felted, layered mat of said mixture on one part of an open mold including two separable parts defining a mold chamber having the desired shape of said pallet, closing the mold and applying sufficient heat and pressure to said mat to compress it into substantially the desired shape and size of said pallet and to bond said wood particles together, said mold including means for compressing the peripheral edge of the deck more than the remainder of the deck.

17. A method for making a unitarily constructed pallet including a deck having an upper supporting surface, a lower surface, and a plurality of integral leg sections extending downwardly from the deck, and the deck having a densified peripheral edge having greater strength and impact resistance than the remainder of said deck, the method including the steps of:

providing a mold apparatus having a female mold member and a male mold member, said female mold member and said male mold member engageable to form a mold cavity including a planar cavity portion and a peripheral portion surrounding said planar cavity portion, said peripheral portion being thinner than said planar portion;

placing a mat comprised of wood flakes and a binder material between said female and male mold members, forcing said female mold member and said male mold member together to shape said pallet and thereby compress said peripheral edge more than said planar body portion whereby said pallet has a densified peripheral edge.

18. A method as set forth in claim 17 and further including the step of forming said mat by intermixing binder with elongated wood flakes laid together in loosely felted relation.

19. A method as set forth in claim 17 and further including the steps of bonding an elongated wood strip to said densified peripheral edge.

20. A method as set forth in claim 17 and further including the step of placing an elongated wood strip in said mold cavity peripheral portion before said mold members are forced together.

* * * * *

UNITED STATES PATENT AND TRADEMARK OFFICE

CERTIFICATE OF CORRECTION

PATENT NO. : 4,248,163

DATED : February 3, 1981

INVENTOR(S) : Bruce A. Haataja, Tauno B. Kilpela, James F. Hamilton and Robert A. Caughey It is certified that error appears in the above—identified patent and that said Letters Patent is hereby corrected as shown below:

Column 3, line 3, "non-planor" should be --non-planar--.

Column 11, line 5, after the word "plurality", --of recesses-- should be inserted.

Signed and Sealed this

*Thirtieth* Day of *June 1981*

[SEAL]

*Attest:*

RENE D. TEGTMEYER

*Attesting Officer*

*Acting Commissioner of Patents and Trademarks*